US012144370B2

(12) United States Patent
Courbat et al.

(10) Patent No.: US 12,144,370 B2
(45) Date of Patent: Nov. 19, 2024

(54) AEROSOL-GENERATING ARTICLE COMPRISING A HEATABLE ELEMENT

(71) Applicant: Philip Morris Products S.A., Neuchatel (CH)

(72) Inventors: Jerome Christian Courbat, Neuchatel (CH); Alexandre Malgat, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 987 days.

(21) Appl. No.: 17/046,429

(22) PCT Filed: Mar. 28, 2019

(86) PCT No.: PCT/EP2019/057941

§ 371 (c)(1),
(2) Date: Oct. 9, 2020

(87) PCT Pub. No.: WO2019/197170

PCT Pub. Date: Oct. 17, 2019

(65) Prior Publication Data

US 2021/0106046 A1 Apr. 15, 2021

(30) Foreign Application Priority Data

Apr. 10, 2018 (EP) ..... 18166657

(51) Int. Cl.
*A24D 1/20* (2020.01)
*A24D 1/02* (2006.01)
(Continued)

(52) U.S. Cl.
CPC ..... *A24D 1/20* (2020.01); *A24D 1/02* (2013.01); *A24F 40/465* (2020.01); *A24F 40/53* (2020.01); *A24F 40/57* (2020.01); *A24F 40/20* (2020.01)

(58) Field of Classification Search
CPC ..... A24D 1/20; A24D 1/02; A24F 40/465; A24F 40/57; A24F 40/53; A24F 40/20; H05B 6/105
See application file for complete search history.

(56) References Cited

U.S. PATENT DOCUMENTS 5,144,962 A 9/1992 Counts et al.
5,902,501 A * 5/1999 Nunnally ..... A24F 40/40 219/269

(Continued)

FOREIGN PATENT DOCUMENTS

CN 104080359 A 10/2014
CN 104095292 A 10/2014

(Continued)

OTHER PUBLICATIONS

Combined Notice of Allowance and Search Report issued Aug. 30, 2022 in Chinese Patent Application No. 201980019840.3 (with English translation of the Search Report), 5 pages.

(Continued)

*Primary Examiner* — Marcus E Harcum
(74) *Attorney, Agent, or Firm* — Oblon, McClelland, Maier & Neustadt, L.L.P.

(57) ABSTRACT

An aerosol-generating article is provided, including: a plurality of elements assembled in the form of a rod having a mouth end and a distal end upstream from the mouth end, the plurality of elements including an aerosol-forming substrate and a plug element disposed upstream of the aerosol-forming substrate, the plug element being cylindrical and formed from a non-inductively-heatable material; a susceptor material arranged in thermal communication with the aerosol-forming substrate; and a layer of inductively-heatable material arranged in contact with the non-inductively-heatable-material. An aerosol-generating system and a (Continued)

method of generating an aerosol from an aerosol-generating article are also provided.

15 Claims, 2 Drawing Sheets

(51) Int. Cl.

| | |
|---|---|
| ***A24F 40/465*** | (2020.01) |
| ***A24F 40/53*** | (2020.01) |
| ***A24F 40/57*** | (2020.01) |
| *A24F 40/20* | (2020.01) |

(56) References Cited

U.S. PATENT DOCUMENTS

| | | | | |
|---|---|---|---|---|
| 10,881,141 | B2 * | 1/2021 | Fraser | A24B 15/167 |
| 2015/0013697 | A1 | 1/2015 | Mironov | |
| 2016/0309782 | A1 * | 10/2016 | Malgat | A24F 40/465 |
| 2016/0331031 | A1 * | 11/2016 | Malgat | A24D 1/20 |
| 2016/0331032 | A1 * | 11/2016 | Malgat | H05B 6/108 |
| 2017/0055574 | A1 * | 3/2017 | Kaufman | A24F 40/42 |
| 2017/0079326 | A1 * | 3/2017 | Mironov | H05B 6/108 |
| 2017/0231278 | A1 * | 8/2017 | Mironov | G01F 23/26 392/390 |
| 2017/0340016 | A1 | 11/2017 | Thorens | |
| 2018/0242644 | A1 * | 8/2018 | Bessant | H05B 3/34 |
| 2019/0069597 | A1 | 3/2019 | Mironov | |
| 2019/0075845 | A1 | 3/2019 | Malgat et al. | |
| 2019/0098927 | A1 | 4/2019 | Mironov | |
| 2019/0200677 | A1 * | 7/2019 | Chong | H05B 6/105 |
| 2019/0281892 | A1 * | 9/2019 | Hejazi | H05B 6/108 |
| 2020/0245686 | A1 * | 8/2020 | Gill | A24F 40/51 |

FOREIGN PATENT DOCUMENTS

| | | | | |
|---|---|---|---|---|
| EP | 2 654 471 | A1 | 10/2013 | |
| EP | 3 694 355 | B1 | 7/2022 | |
| JP | 8-196258 | A | 8/1996 | |
| JP | 2015-509709 | A | 4/2015 | |
| KR | 10-0579783 | B | 5/2006 | |
| KR | 10-2014-0118983 | A | 10/2014 | |
| RU | 2 097 996 | C1 | 12/1997 | |
| RU | 2 233 602 | C2 | 8/2004 | |
| WO | WO 99/20940 | A1 | 4/1999 | |
| WO | WO 2013/098410 | A2 | 7/2013 | |
| WO | WO 2015/082648 | A1 | 6/2015 | |
| WO | WO 2015/082651 | A1 | 6/2015 | |
| WO | WO 2015/116902 | A1 | 8/2015 | |
| WO | WO-2015176898 | A1 * | 11/2015 | A24B 15/167 |
| WO | WO-2015177045 | A1 * | 11/2015 | A24B 15/167 |
| WO | WO 2017/051011 | A1 | 3/2017 | |
| WO | WO 2017/051016 | A1 | 3/2017 | |
| WO | WO 2017/153443 | A1 | 9/2017 | |
| WO | WO 2017/153467 | A1 | 9/2017 | |
| WO | WO 2017/182485 | A1 | 10/2017 | |
| WO | WO 2019/048211 | A1 | 3/2019 | |

OTHER PUBLICATIONS

International Search Report and Written Opinion issued May 9, 2019 in PCT/EP2019/057941 filed Mar. 28, 2019.

European Office Action issued on Aug. 17, 2023 in European Patent Application No. 19 713 058.6, 5 pages.

Combined Russian Office Action and Search Report issued Jun. 27, 2022, in corresponding Russian Patent Application No. 2020136112 (with English Translation), 19 pages.

Combined Chinese Office Action and Search Report issued Apr. 15, 2022, in Chinese Patent Application No. 201980019840.3 (with English translation), 10 pages.

Japanese Decision of Grant issued May 29, 2023 in Japanese Application 2020-555030, (with English translation), 3 pages.

Korean Office Action mailed on Jul. 18, 2024 issued in South Korean Patent Application No. 10-2020-7031717, with English Translation, total 9 pages.

* cited by examiner

AEROSOL-GENERATING ARTICLE COMPRISING A HEATABLE ELEMENT

The present invention relates to an aerosol-generating article comprising a susceptor, a plug element, and a layer of inductively-heatable material. The present invention also relates to an aerosol-generating system comprising the aerosol-generating article, and a method of generating an aerosol from the aerosol-generating article.

Known inductively heatable aerosol-generating articles comprises an aerosol-forming substrate, such as a tobacco plug, and an elongate susceptor arranged in the aerosol-forming substrate. Typically, the aerosol-generating article comprises a plurality of elements in the form of a rod and is adapted to be used in an electrically operated aerosol-generating device comprising an inductor for generating heat in the elongate susceptor. The position of the elongate susceptor may depend on the manufacturing method of the aerosol-forming substrate comprising the susceptor. To prevent an exposed portion of the elongate susceptor at a distal end of the article, which may result in the susceptor being moved or displaced during handling or transport of the article, some articles comprise a plug element at a distal end of the article, upstream of the aerosol-forming substrate. However, since the plug element remains cooler than the aerosol-forming substrate during heating of the susceptor, undesirable condensation of aerosol within the plug element may occur.

It would be desirable to provide an aerosol-generating article comprising an aerosol-forming substrate and a susceptor arranged in the aerosol-forming substrate that mitigates or overcomes such problems with known articles.

According to a first aspect of the present invention there is provided an aerosol-generating article comprising a plurality of elements assembled in the form of a rod having a mouth end and a distal end upstream from the mouth end. The plurality of elements includes an aerosol-forming substrate and a plug element located upstream of the aerosol-forming substrate, wherein the plug element is cylindrical and formed from a non-inductively-heatable material. The aerosol-generating article also comprises a susceptor material arranged in thermal communication with the aerosol-forming substrate. The aerosol-generating article also comprises a layer of inductively-heatable material arranged in contact with the non-inductively-heatable-material.

As used herein, the terms 'upstream' and 'downstream' are used to describe the relative positions of elements, or portions of elements, of the aerosol-generating article in relation to the direction in which a user draws on the aerosol-generating article during use. The aerosol-generating article is in the form of a rod that comprises two ends: a mouth end, or proximal end, through which aerosol exits the aerosol-generating article and is delivered to a user, and a distal end. In use, a user may draw on the mouth end. The distal end may also be referred to as the upstream end and is upstream of the mouth end.

Advantageously, the plug element prevents direct contact with a distal end of the susceptor material and may inhibit or prevent the susceptor material becoming moved or displaced during handling or transport of the aerosol-generating article.

Advantageously, the layer of inductively-heatable material may be inductively heated when the susceptor material is inductively heated to heat the aerosol-forming substrate. Advantageously, inductive heating of the inductively-heatable material results in heating of the plug element formed from a non-inductively-heatable material. Advantageously, heating the plug element may reduce or prevent the condensation of aerosol on or within the plug element.

Preferably, the plug element has a cylindrical shape. The layer of inductively-heatable material may be arranged in contact with an outer circumferential surface of the plug element.

The plug element may be a cylindrical tube formed from the non-inductively-heatable material, the tube having an outer circumferential surface and an inner circumferential surface. The layer of inductively-heatable material may be arranged in contact with at least one of the inner circumferential surface and the outer circumferential surface of the plug element.

The layer of inductively-heatable material may comprise at least one of a metal and carbon. The layer of inductively-heatable material may comprise at least one of a ferromagnetic metal, a ferromagnetic alloy, ferritic iron, and a ferromagnetic steel or stainless steel. Suitable stainless steels may include 400 series stainless steels, such as grade 410, or grade 420, or grade 430 stainless steel.

Preferably, the layer of inductively-heatable material comprises aluminium.

The layer of inductively-heatable material may comprises at least one of a layer of foil and a layer of metallised paper. Advantageously, foil and metallised paper may be handled during the manufacturing process with only small modification to existing manufacturing process and machines. In other words, some machines and processes for manufacturing aerosol-generating articles are typically already arranged to handle sheet materials such as foil and paper.

The layer of inductively-heatable material may comprise a layer of metallic material coated or deposited onto the non-inductively heatable material. For example, the metallic material may be coated or depositing onto the non-inductively-heatable material by at least one of spraying, printing and dipping.

Preferably, the inductively-heatable material is disposed in at least one continuous band extending around at least a portion of the non-inductively-heatable material.

Advantageously, disposing the inductively-heatable material as a continuous band may facilitate the formation of eddy currents in the inductively-heatable material when the aerosol-generating article is positioned in a fluctuating electromagnetic field.

Advantageously, disposing the inductively-heatable material as a continuous band may facilitate positioning of the inductively-heatable material in contact with the plug element in embodiments in which the inductively-heatable material comprises a sheet material such as a foil or a metallised paper. For example, the sheet material may be wrapped around at least a portion of the plug element and secured to itself to form the continuous band.

The at least one continuous band of inductively-heatable material may be a single continuous band of inductively-heatable material. The at least one continuous band of inductively-heatable material may be a plurality of continuous bands of inductively heatable material.

In embodiments in which the plug element is cylindrical, the at least one continuous band of inductively-heatable material may extend around at least a portion of the outer circumferential surface of the plug element.

In embodiments in which the plug element is a cylindrical tube, the at least one continuous band of inductively-heatable material may extend around at least a portion of at least one of the outer circumferential surface and the inner circumferential surface. The at least one continuous band of inductively-heatable material may extend around at least a portion of the outer circumferential surface only. The at least one continuous band of inductively-heatable material may extend around at least a portion of the inner circumferential surface only. The at least one continuous band of inductively-heatable may comprise at least one first continuous band of inductively-heatable material extending around at least a portion of the outer circumferential surface and at least one second continuous band of inductively-heatable material extending around at least a portion of the inner circumferential surface.

The plug element may have a length extending in a longitudinal direction between the mouth end and the distal end of the aerosol-generating article. Preferably, the at least one continuous band of inductively-heatable material has a width extending in the longitudinal direction, wherein the width of the at least one continuous band of inductively-heatable material is between about 50 percent and about 100 percent of the length of the plug element.

Advantageously, providing at least one continuous band of inductively-heatable material having a width of between about 50 percent and about 100 percent of the length of the plug element may provide increased of maximised heating of the plug element when the inductively-heatable material is inductively heated.

Advantageously, providing at least one continuous band of inductively-heatable material having a width of between about 50 percent and about 100 percent of the length of the plug element may provide more even heating of the plug element when the inductively-heatable material is inductively heated.

In embodiments in which the at least one continuous band of inductively-heatable material comprises a single band of inductively-heatable material extending around an outer circumferential surface of the plug element, preferably the band of inductively-heatable material has a width of between about 50 percent and about 100 percent of the length of the plug element.

In embodiments in which the at least one continuous band of inductively-heatable material comprises a single band of inductively-heatable material extending around an inner circumferential surface of the plug element, preferably the band of inductively-heatable material has a width of between about 50 percent and about 100 percent of the length of the plug element.

In embodiments in which the at least one continuous band of inductively-heatable material comprises a plurality of bands of inductively-heatable material extending around an outer circumferential surface of the plug element, preferably the total width of the bands of inductively-heatable material is between about 50 percent and about 100 percent of the length of the plug element.

In embodiments in which the at least one continuous band of inductively-heatable material comprises a plurality of bands of inductively-heatable material extending around an inner circumferential surface of the plug element, preferably the total width of the bands of inductively-heatable material is between about 50 percent and about 100 percent of the length of the plug element.

The layer of inductively-heatable material may have a thickness of between about 100 nanometres and about 50 micrometres. Preferably, the layer of inductively-heatable material has a thickness of between about 2 micrometres and about 50 micrometres, between about 4 micrometres and about 45 micrometres or between about 6 micrometres and about 40 micrometres.

Preferably, the plug element is a porous element. The plug element may be made of a porous material. The plug element may comprise a plurality of openings. The plurality of openings may be formed by any suitable process, such as lase perforation.

The plug element may be made of any material suitable for use in an aerosol-generating article for inductively heatable aerosol-generating devices. The plug element may be made of the same material as one or more other elements of the aerosol-generating article. The plug element may be made of the same material as used in a conventional mouthpiece filter, in an aerosol-cooling element or in a support element. Exemplary materials for the plug element include filter materials, ceramic, polymeric material, cellulose acetate, cardboard, non-inductively heatable metal, zeolite, or aerosol-forming substrate. Preferably, the plug element is made of a heat resistant material. Preferably, the heat resistant material is resistant to temperatures of up to at least about 350 degree Celsius.

Preferably, the plug element has a diameter that is approximately equal to a diameter of the aerosol-generating article. Preferably, the plug element has a diameter of between about 5 millimetres and 10 millimetres. Preferably, the diameter of the plug element is greater than 5 millimetres, for example between about 6 millimetres and about 8 millimetres.

Preferably, the plug element has a length of between about 1 millimetre and about 10 millimetres, preferably between about 4 millimetres and about 8 millimetres, preferably between about 5 millimetres and about 7 millimetres. Preferably, the plug element has a length of less than about 8 millimetres. Preferably, the plug element has a length of at least about 2 millimetres to facilitate assembly of the aerosol-generating article. Preferably, the plug element has a length of preferably at least about 3 millimetres, preferably at least about 5 millimetres.

The aerosol-forming substrate may be a solid aerosol-forming substrate. The aerosol-forming substrate may comprise a tobacco-containing material containing volatile tobacco flavour compounds, which are released from the substrate upon heating. The aerosol-forming substrate may comprise a non-tobacco material. The aerosol-forming substrate may comprise an aerosol former. The aerosol former may comprise at least one of glycerine and propylene glycol.

In embodiments in which the aerosol-forming substrate is a solid aerosol-forming substrate, the solid aerosol-forming substrate may comprise one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form. The aerosol-forming substrate may be provided in a suitable container or cartridge. The aerosol-forming substrate may comprise a plug of solid aerosol-forming substrate. A wrapper may wrapped around the plug of solid aerosol-forming substrate. The wrapper may comprise paper.

The aerosol-forming substrate may comprise one or more sheets of homogenised tobacco material that has been gathered into a rod, circumscribed by a wrapper, and cut to provide individual plugs of aerosol-forming substrate. Preferably, the aerosol-forming substrate comprises a crimped and gathered sheet of homogenised tobacco material. The homogenised tobacco material may comprise at least one of fibres, binder and aerosol former. Preferably, the tobacco sheet is a cast leaf. Cast leaf is a form of reconstituted tobacco that is formed from a slurry including tobacco particles, fibre particles, aerosol former, and binder. The cast leaf may additionally comprise one or more flavours.

The aerosol-forming substrate may have a length extending in the longitudinal direction of the aerosol-generating article. The aerosol-forming substrate may have a length of about 10 millimetres. The aerosol-forming substrate may have a length of about 12 millimetres.

Preferably, the aerosol-forming substrate is substantially cylindrical in shape. The aerosol-forming substrate may have a diameter extending perpendicularly to the longitudinal direction of the aerosol-generating article. The diameter of the aerosol-forming substrate may be between about 5 millimetres and about 12 millimetres.

The susceptor material may comprise any material that can be inductively heated to a temperature sufficient to generate an aerosol from the aerosol-forming substrate. Preferred susceptor materials comprise a metal or carbon. A preferred susceptor may comprise a ferromagnetic material, for example a ferromagnetic alloy, ferritic iron, or a ferromagnetic steel or stainless steel. A suitable susceptor may comprise aluminium. Preferred susceptor materials include 400 series stainless steels, for example grade 410, or grade 420, or grade 430 stainless steel.

The susceptor material may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor material is arranged in thermal contact with the aerosol-forming substrate. Preferably, the susceptor material is arranged in direct physical contact with the aerosol-forming substrate. The susceptor material may be positioned within the aerosol-forming substrate.

The aerosol-generating article may comprise a mouthpiece element. The mouthpiece element may be located at the mouth end or downstream end of the aerosol-generating article.

The mouthpiece element may comprise at least one filter segment. The filter segment may be a cellulose acetate filter plug made of cellulose acetate tow. A filter segment may have low particulate filtration efficiency or very low particulate filtration efficiency. A filter segment may be longitudinally spaced apart from the aerosol-forming substrate. The filter segment may have a length in the longitudinal direction of between about 5 millimetres and about 14 millimetres. The filter segment may have a length of about 7 millimetres.

The plurality of element of the aerosol-generating article may comprise at least one of a support element and an aerosol-cooling element.

Preferably, the aerosol-generating article comprises a wrapper wrapping the plurality of elements of the aerosol-generating article in the form of a rod. The wrapper may comprise at least one of a paper and a foil.

The aerosol-generating article may be substantially cylindrical in shape. The aerosol-generating article may be substantially elongate. The aerosol-generating article may have a length and a circumference substantially perpendicular to the length. The aerosol-generating article may have a total length of between about 30 millimetres and about 100 millimetres. In preferred embodiments, the aerosol-generating article has a total length of between about 40 millimetres and about 55 millimetres. The aerosol-generating article may have a total length of between about 47 millimetres and about 53 millimetres or about 45 mm.

The aerosol-generating article may have an external diameter of between about 5 millimetres and about 12 millimetres, for example of between about 6 millimetres and about 8 millimetres. In a preferred embodiment, the aerosol-generating article has an external diameter of about 7.2 millimetres.

According to a second aspect of the present invention there is provided an aerosol-generating system comprising an aerosol-generating article according to the first aspect of the present invention, in accordance with any of the embodiments described herein. The aerosol-generating system also comprises an aerosol-generating device, the aerosol-generating device comprising a cavity for receiving the aerosol-generating article and an inductor for generating a fluctuating electromagnetic field within the cavity.

Preferably, the inductor comprises an induction coil.

The induction coil may at least partially surround at least a portion of the cavity. The induction coil may be arranged so that, when the aerosol-generating article is received within the cavity, the aerosol-generating article is at least partially received within the induction coil.

The induction coil may comprise a flat induction coil. The flat induction coil may be a flat spiral induction coil.

Preferably, the inductor is arranged to heat the susceptor material of the aerosol-generating article, when received in the cavity, to a temperature of between about 200 degrees Celsius and about 400 degrees Celsius and simultaneously heat the layer of inductively-heatable material to a temperature of between about 50 degrees Celsius and about 150 degrees Celsius.

Preferably, the aerosol-generating device comprises a power supply and a controller arranged to supply power from the power supply to the inductor to generate the fluctuating electromagnetic filed within the cavity.

The power supply may be a DC voltage source. In preferred embodiments, the power supply is a battery. For example, the power supply may be a nickel-metal hydride battery, a nickel cadmium battery, or a lithium based battery, for example a lithium-cobalt, a lithium-iron-phosphate or a lithium-polymer battery. The power supply may alternatively be another form of charge storage device such as a capacitor. The power supply may require recharging and may have a capacity that allows for the storage of enough energy for use of the aerosol-generating device with one or more aerosol-generating articles.

The aerosol-generating device may comprise a detection circuit arranged to detect the presence of the inductively-heatable material within the cavity. Preferably, the controller is arranged to supply power to the inductor only when the detection circuit detects the presence of the inductively-heatable material within the cavity.

The detection circuit may comprise a first electrode and a second electrode arranged to receive at least a portion of the inductively-heatable material between the first and second electrodes when the aerosol-generating article is received within the cavity.

The controller may be arranged to measure at least one of a resistance and a capacitance between the first and second electrodes to detect the presence of the inductively-heatable material within the cavity.

The detection circuit may comprise an inductor. The inductor may be arranged to receive at least a portion of the inductively-heatable material when the aerosol-generating article is received within the cavity. The controller may be arranged to measure an of the inductor to detect the presence of the inductively-heatable material within the cavity. Preferably, the inductor comprises an induction coil. The induction coil may at least partially surround the cavity.

Preferably, the inductor is a second inductor, separate from the inductor for heating the susceptor material of the aerosol-generating article. However, in some embodiments, the inductor may be the inductor for heating the susceptor material of the aerosol-generating article. In these embodiments, the controller may be arranged to provide a lower power to the inductor for measuring the inductance between the first and second electrodes to detect the presence of the inductively-heatable material within the cavity, and to provide a higher power to the inductor when the presence of the inductively-heatable material within the cavity is detected for heating the susceptor material of the aerosol-generating article.

Preferably, the aerosol-generating device comprises at least one air inlet. Preferably, the at least one air inlet is in fluid communication with an upstream end of the cavity.

The aerosol-generating device may comprise a sensor to detect air flow indicative of a consumer taking a puff. The air flow sensor may be an electro-mechanical device. The air flow sensor may be any of: a mechanical device, an optical device, an opto-mechanical device and a micro electro-mechanical systems (MEMS) based sensor. The aerosol-generating device may comprise a manually operable switch for a consumer to initiate a puff.

Preferably, the aerosol-generating device comprises an indicator for indicating when the inductor is activated. The indicator may comprise a light, activated when the inductor is activated.

The aerosol-generating device may comprise at least one of an external plug or socket and at least one external electrical contact allowing the aerosol-generating device to be connected to another electrical device. For example, the aerosol-generating device may comprise a USB plug or a USB socket to allow connection of the aerosol-generating device to another USB enabled device. For example, the USB plug or socket may allow connection of the aerosol-generating device to a USB charging device to charge a rechargeable power supply within the aerosol-generating device. The USB plug or socket may additionally, or alternatively, support the transfer of data to or from, or both to and from, the aerosol-generating device. Additionally, or alternatively, the aerosol-generating device may be connected to a computer to transfer data to the device, such as new heating profiles for new aerosol-generating articles.

In those embodiments in which the aerosol-generating device comprises a USB plug or socket, the aerosol-generating device may further comprise a removable cover that covers the USB plug or socket when not in use. In embodiments in which the USB plug or socket is a USB plug, the USB plug may additionally or alternatively be selectively retractable within the device.

According to a third aspect of the present invention there is provided a method of generating an aerosol from an aerosol-generating article according to the first aspect of the present invention, in accordance with any of the embodiments described herein. The method comprising the steps of positioning the aerosol-generating article in a fluctuating electromagnetic field and inductively heating the susceptor material to a temperature of between about 200 degrees Celsius and about 400 degrees Celsius and simultaneously inductively heating the layer of inductively-heatable material to a temperature of between about 50 degrees Celsius and about 150 degrees Celsius.

The positioning step of positioning the aerosol-generating article in a fluctuating electromagnetic field may comprise positioning the aerosol-generating article within a cavity of an aerosol-generating device in accordance with the second aspect of the present invention, according to any of the embodiments described herein. The step of inductively heating the susceptor material and the layer of inductively-heatable material may comprise activating the inductor of the aerosol-generating device.

The invention will now be further described, by way of example only, with reference to the accompanying drawings in which.

Figure 1:
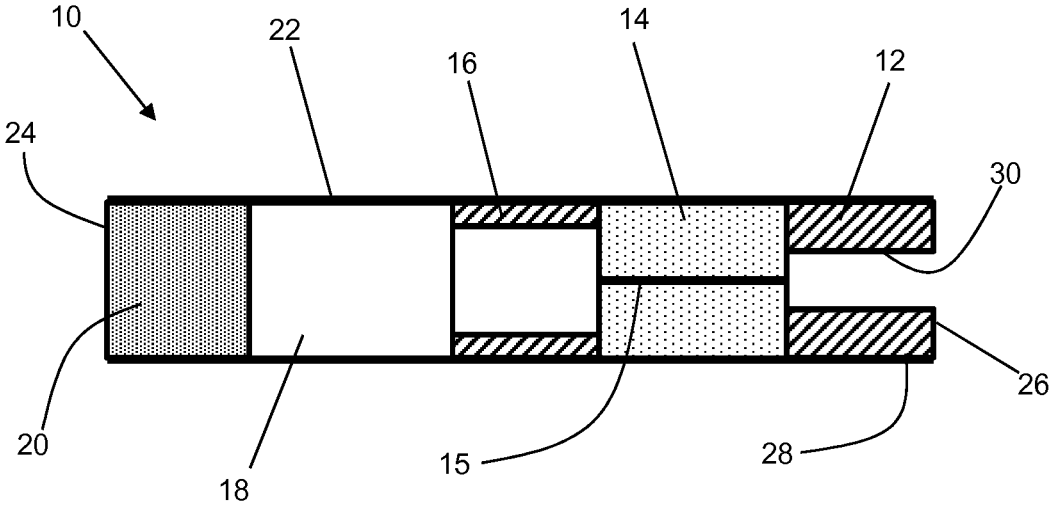
FIG. 1 shows a cross-sectional view of an aerosol-generating article according to an embodiment of the present invention.

FIG. 1 shows a cross-sectional view of an aerosol-generating article 10 according to an embodiment of the present invention. The aerosol-generating article 10 comprises a plurality of elements assembled in the form of a rod. The plurality of elements comprises a plug element 12, an aerosol-forming substrate 14 in the form of a tobacco plug, a susceptor material 15 positioned within the aerosol-forming substrate 14, a hollow acetate tube 16, a polymeric aerosol-cooling element 18, a mouthpiece 20, and an outer wrapper 22. The aerosol-generating article 10 comprises a mouth end 24 and a distal end 26.

The plug element 12 has a cylindrical shape and is formed from a tube of non-inductively-heatable material 27. The plug element 12 has an outer circumferential surface 28 and an inner circumferential surface 30.

Figure 2:
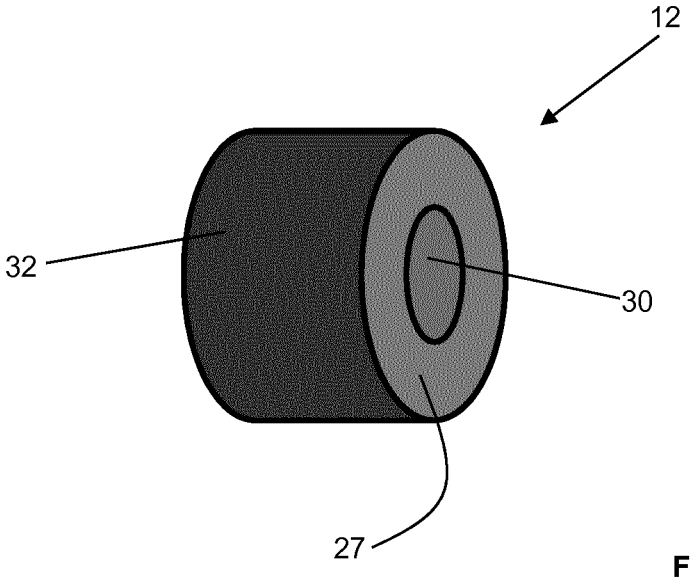
FIG. 2 shows a perspective view of the plug element of the aerosol-generating article of FIG. 1.

As shown in FIG. 2, the aerosol-generating article 10 also comprise a layer of inductively-heatable material 32. The layer of inductively-heatable material 32 is provided as a continuous band extending around the outer circumferential surface 28 of the plug element 12. The continuous band is formed from a sheet of aluminium wrapped around the plug element 12. The continuous band has a width corresponding to a length of the plug element 12 so that the layer of inductively-heatable material entirely covers the outer circumferential surface 28 of the plug element 12.

It will be appreciated that in other embodiments of the invention the layer of inductively-heatable material may not entirely cover the outer circumferential surface of the plug element. For example, in some embodiments one or more rings of inductively-heatable material may be provided around the outer circumferential surface of the plug element. Where two or more rings of inductively-heatable material are provided around the outer circumferential surface of the plug element, adjacent rings may be spaced apart such that a portion of the outer circumferential surface of the plug element between the adjacent rings is not covered by the inductively-heatable material. In some embodiments, the inductively-heatable material may only partially cover the outer circumferential surface of the plug element.

Figure 3:
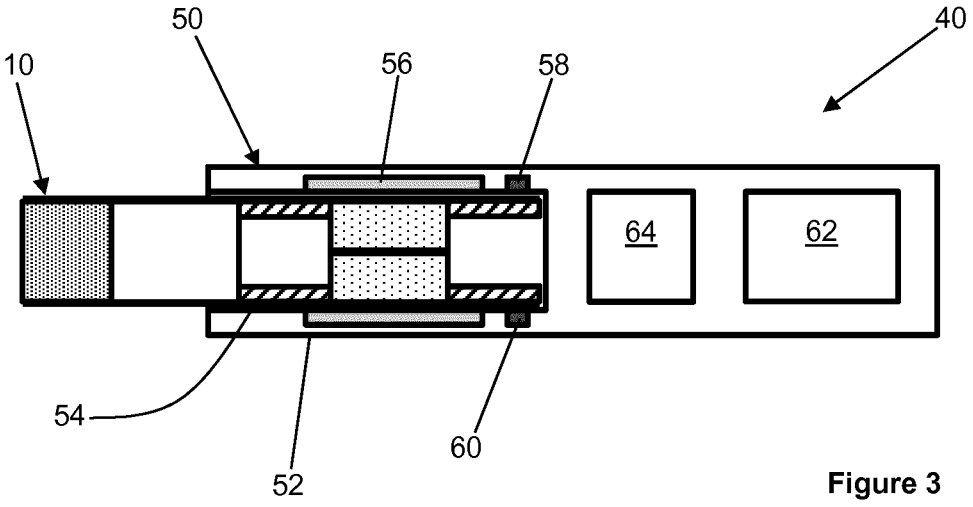
FIG. 3 shows a cross-sectional view of an aerosol-generating system comprising the aerosol-generating article of FIG. 1.

FIG. 3 shows a cross-sectional view of an aerosol-generating system 40 comprising the aerosol-generating article 10 and an aerosol-generating device 50. The aerosol-generating device 50 comprises a housing 52 defining a cavity 54 for receiving the aerosol-generating article 10.

The aerosol-generating device 50 also comprises an inductor 56 comprising an induction coil extending around a portion of the cavity 54 so that, when the aerosol-generating article 10 is received within the cavity 54, the aerosol-forming substrate 14 and the susceptor material 15 are positioned within the induction coil.

The aerosol-generating device 50 also comprises a first electrode 58 and a second electrode 60 arranged on opposite sides of the cavity 54 so that, when the aerosol-generating article 10 is received within the cavity 54, the layer of inductively-heatable material 32 is positioned between the first and second electrodes 58, 60.

The aerosol-generating device 50 further comprises a power supply 62 and a controller 64. The controller 64 is arranged to supply power from the power supply 62 to the inductor 56 to generate a fluctuating electromagnetic field within the cavity 54. In combination with the first and second electrodes 58, 60, the controller 64 also forms a detection circuit.

During use, the aerosol-generating article 10 is inserted into the cavity 54. The detection circuit comprising the controller 64 and the first and second electrodes 58, 60 detect the insertion of the aerosol-generating article 10 into the cavity 54 as a result of a change in at least one of a resistance and a capacitance between the first and second electrodes 58, 60. The change in resistance or capacitance is a result of the presence of the layer of inductively-heatable material 32 between the first and second electrodes 58, 60.

In response to the detection of the aerosol-generating article 10 being inserted into the cavity 54, the controller 64 enables a supply of power from the power supply 62 to the inductor 56 to generate a fluctuating electromagnetic field within the cavity 64. The fluctuating electromagnetic field inductively heats the susceptor material 15, which in turn heats the aerosol-forming substrate 14 to generate an aerosol. The fluctuating electromagnetic field also inductively heats the layer of inductively-heatable material 32, which in turn heats the plug element 12. Advantageously, heating the plug element 12 reduces or prevents the condensation of aerosol within the plug element 12.

Although in this embodiment the first electrode 58 and the second electrode 60 are arranged on opposite sides of the cavity 54, it will be appreciated that in other embodiments the first and second electrodes may not be arranged on opposite sides of the cavity, provided that the layer of inductively-heatable material is positioned between the first and second electrodes when the article is inserted into the cavity.

It will also be appreciated that in some embodiments the first and second electrodes may be replaced by a second inductor comprising a second inductor coil extending around a second portion of the cavity so that, when the aerosol-generating article is received within the cavity 54, the layer of inductively-heatable material is positioned in the second inductor. In these embodiments, the detection circuit comprising the controller and the second inductor detect the insertion of the aerosol-generating article into the cavity as a result of a change in the inductance of the second inductor. The change in inductance is a result of the presence of the layer of inductively-heatable material within the second inductor.

Figure 4:
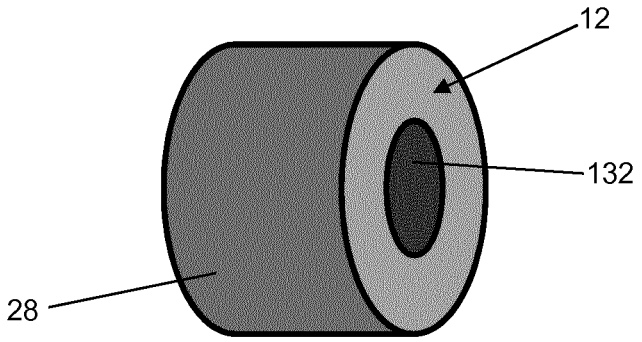
FIG. 4 shows a perspective view of an alternative arrangement of the plug element of the aerosol-generating article of FIG. 1.

FIG. 4 shows an alternative arrangement of the plug element 12 of the aerosol-generating article 10. Instead of a layer of inductively-heatable material 32 extending around the outer circumferential surface 28 of the plug element 12, the alternative arrangement shown in FIG. 4 comprises a layer of inductively-heatable material 132 extending around the inner circumferential surface 30 of the plug element 12.

The layer of inductively-heatable material 132 is provided as a continuous band extending around the inner circumferential surface 30 of the plug element 12. The continuous band is formed from a sheet of aluminium wrapped around the inner circumferential surface 30 of the plug element 12. The continuous band has a width corresponding to a length of the plug element 12 so that the layer of inductively-heatable material entirely covers the inner circumferential surface 30 of the plug element 12.

Figure 5:
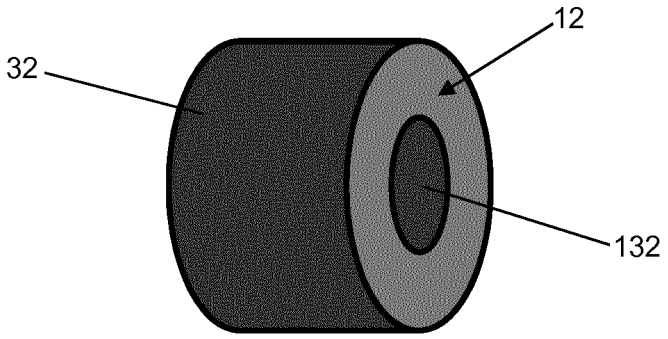
FIG. 5 shows a perspective view of a further alternative arrangement of the plug element of the aerosol-generating article of FIG. 1.

FIG. 5 shows a further alternative arrangement of the plug element 12. The arrangement shown in FIG. 5 is a combination of the two arrangements shown in FIGS. 2 and 4. Therefore, in the arrangement shown in FIG. 5, a first layer of inductively-heatable material 32 extends around the outer circumferential surface 28 of the plug element 12 and a second layer of inductively heatable material 132 extends around the inner circumferential surface 30 of the plug element 12.

The invention claimed is:

1. An aerosol-generating article, comprising:

a plurality of elements assembled in the form of a rod having a mouth end and a distal end upstream from the mouth end, the plurality of elements including an aerosol-forming substrate and a plug element disposed upstream of the aerosol-forming substrate, wherein the plug element is cylindrical and formed from a non-inductively-heatable material;

a susceptor material arranged in thermal communication with the aerosol-forming substrate; and a layer of inductively-heatable material arranged in contact with the non-inductively-heatable-material.

2. The aerosol-generating article according to claim 1, wherein the plug element is a cylindrical tube formed from the non-inductively-heatable material, the tube having an outer circumferential surface and an inner circumferential surface, and wherein the layer of inductively-heatable material is arranged in contact with at least one of the inner circumferential surface and the outer circumferential surface.

3. The aerosol-generating article according to claim 1, wherein the inductively-heatable material comprises at least one of a layer of foil and a layer of metallised paper coupled to the non-inductively heatable material.

4. The aerosol-generating article according to claim 1, wherein the inductively-heatable material comprises a layer of metallic material coated or deposited onto the non-inductively heatable material.

5. The aerosol-generating article according to claim 1, wherein the inductively-heatable material is disposed in at least one continuous band extending around at least a portion of the non-inductively-heatable material.

6. The aerosol-generating article according to claim 5, wherein the plug element has a length extending in a longitudinal direction between the mouth end and the distal end of the aerosol-generating article, wherein the at least one continuous band of inductively-heatable material has a width extending in the longitudinal direction, and wherein the width of the at least one continuous band of inductively-heatable material is between 50 percent and 100 percent of the length of the plug element.

7. The aerosol-generating article according to claim 1, wherein the layer of inductively-heatable material has a thickness of between about 100 nanometres and about 50 micrometres.

8. An aerosol-generating system, comprising:

an aerosol-generating article according to claim 1; and an aerosol-generating device:

a cavity configured to receive the aerosol-generating article; and an inductor configured to generate a fluctuating electromagnetic field within the cavity.

9. The aerosol-generating system according to claim 8, wherein the inductor is configured to heat the susceptor material of the aerosol-generating article, when received in the cavity, to a temperature of between 200 degrees Celsius and 400 degrees Celsius and simultaneously heat the layer of inductively-heatable material to a temperature of between 50 degrees Celsius and 150 degrees Celsius.

10. The aerosol-generating system according to claim 8, further comprising a power supply and a controller configured to supply power from the power supply to the inductor to generate the fluctuating electromagnetic field within the cavity.

11. The aerosol-generating system according to claim 10, further comprising a detection circuit configured to detect the presence of the inductively-heatable material within the cavity.

12. The aerosol-generating system according to claim 11, wherein the controller is further configured to supply power to the inductor only when the detection circuit detects the presence of the inductively-heatable material within the cavity.

13. The aerosol-generating system according to claim 11, wherein the detection circuit comprises a first electrode and a second electrode configured to receive at least a portion of the inductively-heatable material between the first and the second electrodes when the aerosol-generating article is received within the cavity.

14. The aerosol-generating system according to claim 13, wherein the controller is further configured to measure at least one of a resistance and a capacitance between the first and the second electrodes to detect the presence of the inductively-heatable material within the cavity.

15. A method of generating an aerosol from an aerosol-generating article according to claim 1, the method comprising the steps of:

positioning the aerosol-generating article in a fluctuating electromagnetic field; and inductively heating a susceptor material of the aerosol-generating article to a temperature of between 200 degrees Celsius and 400 degrees Celsius and simultaneously inductively heating a layer of inductively-heatable material to a temperature of between 50 degrees Celsius and 150 degrees Celsius.

* * * * *